US009189991B2

(12) United States Patent
Ka et al.

(10) Patent No.: US 9,189,991 B2
(45) Date of Patent: Nov. 17, 2015

(54) ORGANIC LIGHT EMITTING DISPLAY DEVICE HAVING PIXELS AND METHOD OF DRIVING THE SAME

(71) Applicant: SAMSUNG DISPLAY CO., LTD., Yongin-si, Gyeonggi-do (KR)

(72) Inventors: Ji-Hyun Ka, Yongin-si (KR); Kwang-Min Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 134 days.

(21) Appl. No.: 13/633,737

(22) Filed: Oct. 2, 2012

(65) Prior Publication Data

US 2013/0321375 A1 Dec. 5, 2013

(30) Foreign Application Priority Data

May 29, 2012 (KR) ..... 10-2012-0056805

(51) Int. Cl.
*G09G 3/30* (2006.01)
*G09G 3/32* (2006.01)

(52) U.S. Cl.
CPC ..... *G09G 3/3233* (2013.01); *G09G 3/30* (2013.01); *G09G 3/3208* (2013.01); *G09G 2300/0819* (2013.01); *G09G 2300/0842* (2013.01); *G09G 2300/0861* (2013.01); *G09G 2310/0202* (2013.01); *G09G 2310/061* (2013.01); *G09G 2320/043* (2013.01); *G09G 2320/045* (2013.01)

(58) Field of Classification Search
CPC . G09G 3/3208; G09G 2320/045; G09G 3/30; G09G 2320/0453
USPC ..... 345/76, 82
See application file for complete search history.

(56) References Cited

U.S. PATENT DOCUMENTS

| | | | | |
|---|---|---|---|---|
| 8,587,569 | B2 * | 11/2013 | Ono | 345/204 |
| 2005/0017934 | A1 * | 1/2005 | Chung et al. | 345/82 |
| 2006/0071884 | A1 * | 4/2006 | Kim | 345/76 |
| 2008/0036704 | A1 * | 2/2008 | Kim et al. | 345/76 |
| 2008/0074412 | A1 * | 3/2008 | Nozawa | 345/212 |
| 2011/0157144 | A1 * | 6/2011 | Park et al. | 345/212 |
| 2012/0038683 | A1 * | 2/2012 | Park et al. | 345/690 |
| 2012/0188150 | A1 * | 7/2012 | Shirouzu et al. | 345/76 |
| 2014/0062982 | A1 * | 3/2014 | Lee et al. | 345/211 |

FOREIGN PATENT DOCUMENTS

| | | |
|---|---|---|
| KR | 10-2011-0121889 | 11/2011 |
| KR | 10-1139529 | 5/2012 |

OTHER PUBLICATIONS

Korean Patent Abstracts, Publication No. 10-2007002155 A, dated Jan. 5, 2007, for corresponding Korean Patent KR 10-1139529 listed above.

* cited by examiner

*Primary Examiner* — Chanh Nguyen
*Assistant Examiner* — Yuzhen Shen
(74) *Attorney, Agent, or Firm* — Christie, Parker & Hale, LLP

(57) ABSTRACT

Disclosed herein is an organic light emitting display device capable of stably compensating for a threshold voltage of a driving transistor. The organic light emitting display device according the present invention includes pixels, each for storing a voltage of a data signal in a storage capacitor through a first threshold voltage different from a second threshold voltage of a driving transistor for driving the pixel; scan lines and light emitting control lines respectively coupled to the pixels; and data lines for supplying the data signal to the pixels.

8 Claims, 3 Drawing Sheets

ORGANIC LIGHT EMITTING DISPLAY DEVICE HAVING PIXELS AND METHOD OF DRIVING THE SAME

CROSS-REFERENCE TO RELATED APPLICATION

This application claims priority to and the benefit of Korean Patent Application No. 10-2012-0056805, filed on May 29, 2012, in the Korean Intellectual Property Office, the entire content of which is incorporated herein by reference.

BACKGROUND

1. Field of the Device

Embodiments of the present invention relate to an organic light emitting display device having pixels and a method of driving the same.

2. Description of the Related Art

Recently, various flat panel display devices capable of reducing weight and volume as compared to a cathode ray tube have been developed. These flat panel display devices include a liquid crystal display (LCD), a field emission display (FED), a plasma display panel (PDP), an organic light emitting display (OLED) device, and the like.

Among them, the organic light emitting display device, which displays an image using organic light emitting diodes that generate light by recombining electrons and holes, has a rapid response speed and can be driven at a low power.

The organic light emitting display device includes a plurality of data lines, scan lines, and a plurality of pixels arranged in the form of a matrix at crossing regions of the data lines, the scan lines, and/or the power lines. Each of the pixels generally includes an organic light emitting diode, two or more transistors including a driving transistor, and one or more capacitors.

The organic light emitting display device described above has low power consumption, whereas an amount of current flowing to the organic light emitting diode is varied according to the threshold voltage variation of the driving transistor included in each pixel, which causes non-uniformity of the display. That is, according to a production process variable of the driving transistor included in each pixel, characteristics of the driving transistor may be changed. In practice, it is impossible or very difficult that all transistors in the organic light emitting display device are manufactured in currently known process steps so as to have the same characteristics. Therefore, the threshold voltage variation of the driving transistors occurs.

In order to solve the problem described above, a method of adding a compensation circuit formed of a plurality of transistors and capacitors to each pixel has been proposed. The compensation circuit allows the driving transistor to be connected in a diode form during a scan-on time, thereby compensating for the threshold voltage variation of the driving transistors.

Recently, in order to improve image quality, a method of driving an organic light emitting display device at a high definition and/or a high driving frequency has been proposed. However, in the case in which a panel is driven at the high definition and/or the high driving frequency, a supply time of the scan signals is reduced, and as a consequence, it is impossible or very difficult to compensate for the threshold voltage of the driving transistors.

SUMMARY OF THE EMBODIMENTS

Embodiments of the prevent invention provide an organic light emitting display device capable of stably compensating for a threshold voltage of a driving transistor and a method of driving the same.

According to one embodiment of the present invention, there is provided an organic light emitting display device including: pixels, each of the pixels being configured to store a voltage of a data signal in a storage capacitor through a first threshold voltage different from a second threshold voltage of a driving transistor for driving the pixel; scan lines and light emitting control lines respectively coupled to the pixels; and data lines for supplying the data signal to the pixels.

An absolute value of the first threshold voltage may be set to be higher than that of the second threshold voltage. The first threshold voltage may be obtained by adding a threshold voltage of a separate transistor connected in a diode form to the second threshold voltage. Each of the pixels may include an organic light emitting diode, a storage capacitor, the driving transistor for controlling an amount of current supplied from a first power supply coupled to a first electrode thereof to the organic light emitting diode corresponding to a voltage charged in the storage capacitor, a second transistor coupled between a second electrode and a gate electrode of the driving transistor and having a gate electrode coupled to the gate electrode of the driving transistor, and a third transistor coupled between the second transistor and the gate electrode of the driving transistor, and configured to be turned on when a scan signal is supplied to a current scan line.

The first threshold voltage may be an absolute voltage obtained by adding the threshold voltage of the second transistor to the threshold voltage of the driving transistor. Each of the pixels may further include a fourth transistor coupled between the data line and the first electrode of the driving transistor, and configured to be turned on when the scan signal is supplied to a current scan line, a fifth transistor coupled between the first power supply and the first electrode of the first driving transistor, and configured to be turned on when the light emitting control signal is not supplied to the light emitting control line, a sixth transistor coupled between the second electrode of the driving transistor, and configured to be turned off when the light emitting control signal is not supplied, and a seventh transistor coupled between the gate electrode of the driving transistor and an initialization power supply, and configured to be turned on when the scan signal is supplied to a previous scan line. The initialization power supply may be set to have a voltage lower than that of the data signal.

According to another embodiment of the present invention, there is provided a method of driving an organic light emitting display device including: storing a data signal in a storage capacitor through a first threshold voltage different from a second threshold voltage of a driving transistor; and supplying current corresponding to the voltage stored in the storage capacitor from the driving transistor to an organic light emitting diode.

An absolute value of the first threshold voltage may be set to be higher than that of the second threshold voltage. The storing a data signal includes supplying the data signal to the storage capacitor through the driving transistor connected in a diode form and a separate transistor that is diode-connected.

According to still another embodiment of the present invention, there is provided a pixel including: an organic light emitting diode; a storage capacitor coupled between a node and a first power supply; a first transistor having a first electrode coupled to the first power supply, a second electrode coupled to the organic light emitting diode, and a gate electrode coupled to the node; a second transistor coupled between the second electrode of the first transistor and the node, and a gate electrode of the second transistor being coupled to the node; and a third transistor coupled between the second transistor and the second node, and a gate electrode of the third transistor being coupled to a current scan line.

The pixel may further include: a fourth transistor coupled between a data line and the first electrode of the first transistor, and a gate electrode of the fourth transistor being coupled to the current scan line; a fifth transistor coupled between the first electrode of the first transistor and the first power supply, and a gate electrode of the fifth transistor being coupled to a light emitting control line; a sixth transistor coupled between a second electrode of the first transistor and the organic light emitting diode, and a gate electrode of the sixth transistor being coupled to the light emitting control line; and a seventh transistor coupled between the node and an initializing power supply, and a gate electrode of the seventh transistor being coupled to a previous scan line. A light emitting control signal supplied to the light emitting control line may be overlapped with scan signals supplied to the previous scan line and the current scan line. The fifth and sixth transistors may be configured to be turned off when the light emitting control signal is supplied, and turned on in other cases.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
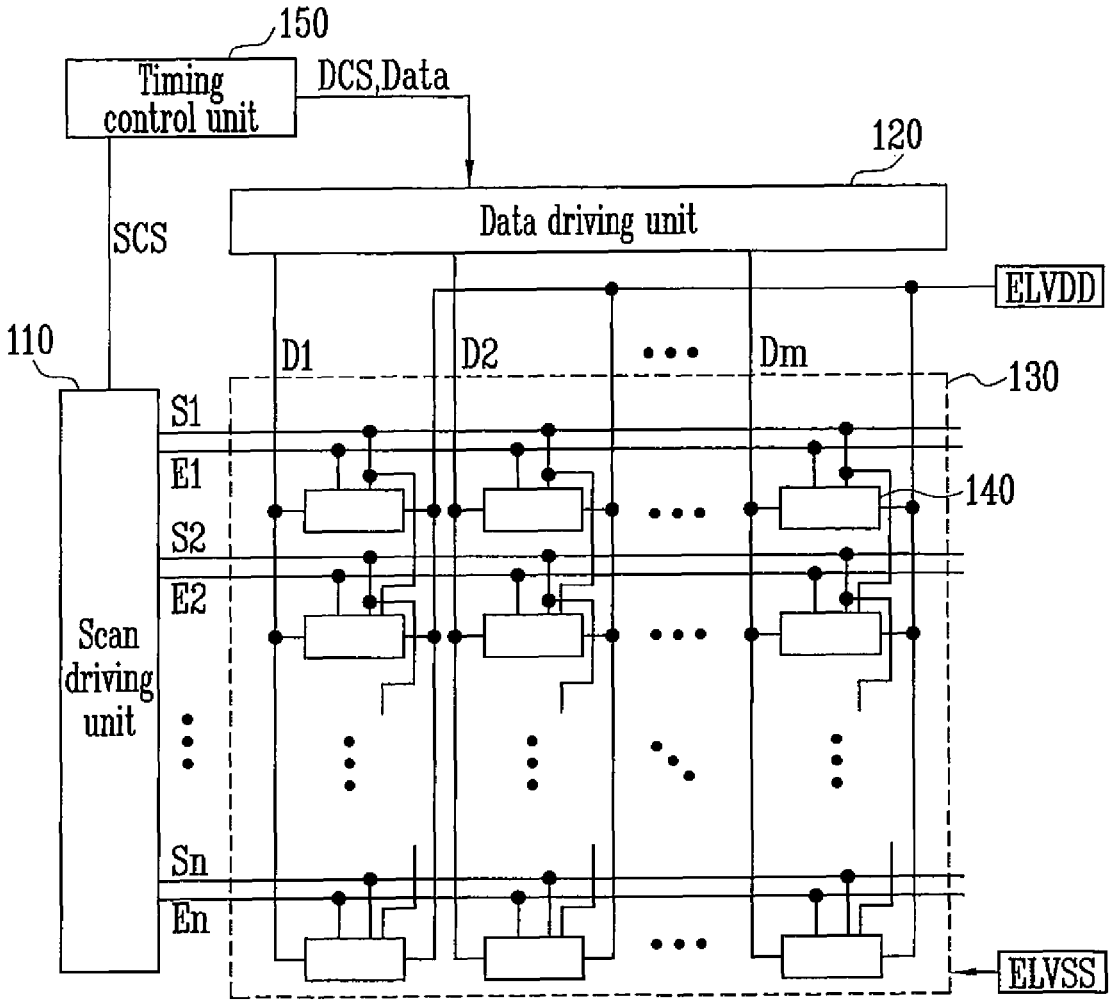
FIG. 1 is a schematic drawing showing an organic light emitting display device according to an exemplary embodiment of the present invention.

Hereinafter, certain exemplary embodiments according to the present invention will be described with reference to the accompanying drawings. Here, when a first element is described as being coupled to a second element, the first element may be directly coupled to the second element, or indirectly coupled to the second element via a third element. Further, some of the elements that are not essential to the complete understanding of the invention may be omitted for clarity. Also, like reference numerals refer to like elements throughout.

Hereinafter, exemplary embodiments of the prevent invention which those skilled in the art may perform easily will be described below in detail with reference to FIGS. 1 to 4B.

FIG. 1 is a schematic diagram showing an organic light emitting display device according to an exemplary embodiment of the present invention.

Referring to FIG. 1, the organic light emitting display device according to the exemplary embodiment of the present invention is configured to include a pixel unit 130 including pixels 140 positioned at crossing regions of scan lines S1 to Sn and data lines D1 to Dm, a scan driving unit 110 for driving the scan lines S1 to Sn and light emitting control lines E1 to En, a data driving unit 120 for driving the data lines D1 to Dm, and a timing control unit 150 for controlling the data driving unit 120 and the scan driving unit 110.

The timing control unit 150 generates a data driving control signal DCS and a scan driving control signal SCS corresponding to synchronized signals supplied from the outside. The data driving control signal DCS generated in the timing control unit 150 is supplied to the data driving unit 120, and the scan driving control signal SCS is supplied to the scan driving unit 110. In addition, the timing control unit 150 supplies data supplied from the outside to the data driving unit 120.

The scan driving unit 110 receives a scan driving control signal SCS. In response to receiving the scan driving control signal SCS, the scan driving unit 110 generates a scan signal and supplies the generated scan signal sequentially to the scan lines S1 to Sn. In addition, the scan driving unit 110 generates a light emitting control signal in response to the scan control signal SCS and supplies the generated light emitting control signal sequentially to the light emitting control lines E1 to En. Here, the light emitting control signal is set to have a width (e.g., pulse width) that is substantially the same as or wider than that of the scan signal. For example, the light emitting control signal supplied to the i-th light emitting control line Ei (i is a natural number) is overlapped with scan signals supplied to the (i−1)-th and the i-th scan lines Si−1 and Si.

The data driving unit 120 receives the data driving control signal DCS from the timing control unit 150. In response to receiving the data driving control signal DCS, the data driving unit 120 generates the data signal and supplies the generated data signal to the data lines D1 to Dm so as to synchronize with the scan signal.

The pixel unit 130 receives powers of a first power supply ELVDD and a second power supply ELVSS from the outside and supplies the powers to each of the pixels 140. Each of the pixels 140 receiving powers of the first and second power supplies ELVDD and ELVSS generates light corresponding to the data signal. Here, each of the pixels 140 stores a voltage of the data signal in a storage capacitor through a threshold voltage having an absolute value higher than that of a second threshold voltage of the driving transistor. In this case, the threshold voltage of the driving transistor may be stably compensated for during the scan-on time. In relation to this embodiment, detailed description will be described below.

Figure 2:
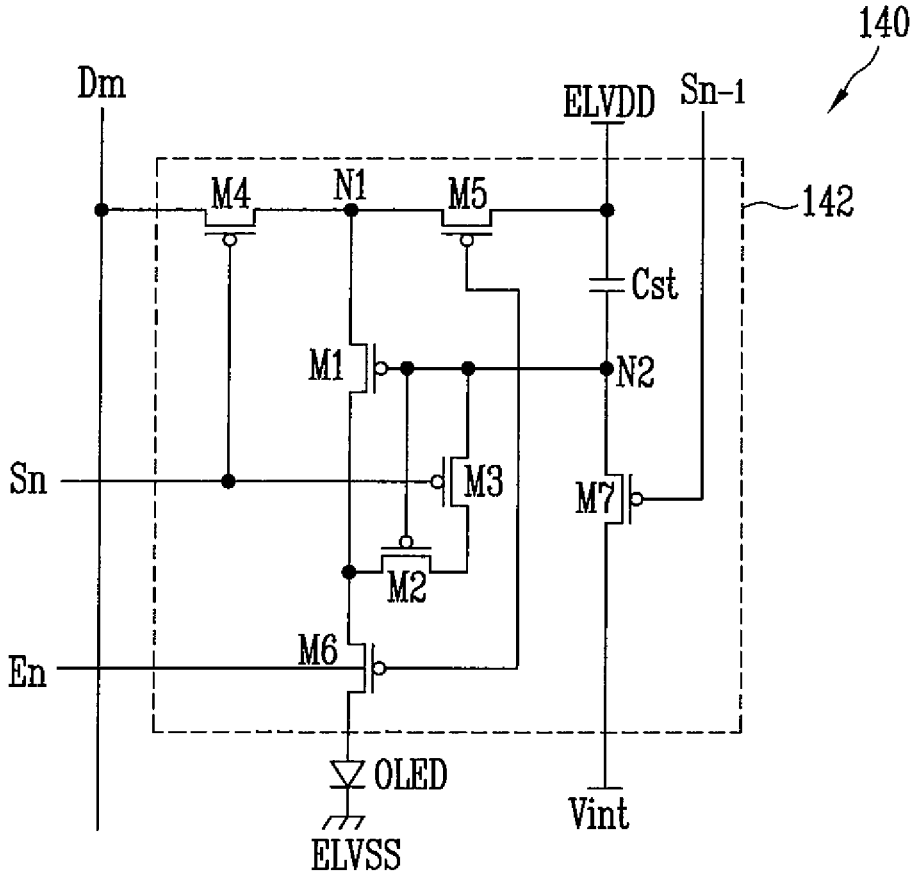
FIG. 2 is a schematic drawing showing an example of a pixel shown in FIG. 1.

FIG. 2 is a schematic diagram showing an example of a pixel shown in FIG. 1. In FIG. 2, for convenience of explanation, a pixel coupled to an m-th data line Dm, an n-th scan line Sn, an (n−1)-th scan line Sn−1, and an n-th light emitting control line En is shown.

Referring to FIG. 2, the pixel 140 according to the exemplary embodiment of the present invention includes a pixel circuit 142 coupled to an organic light emitting diode (OLED), the data line Dm, the scan lines Sn−1 and Sn, and the light emitting control line En to control an amount of current supplied to the OLED.

An anode electrode of the OLED is coupled to the pixel circuit 142, and a cathode electrode thereof is coupled to the second power supply ELVSS. Here, the second power supply ELVSS is set to have a voltage value lower than that of the first power supply ELVDD. The OLED described above generates light having a set or predetermined brightness corresponding to the amount of current supplied from the pixel circuit 142.

The pixel circuit 142 controls an amount of current supplied to the OLED corresponding to the data signal supplied to the data line Dm when the scan signal is supplied to the scan line Sn. To this end, the pixel circuit 142 includes first to seventh transistors M1 to M7 and a storage capacitor Cst.

A first electrode of the fourth transistor M4 is coupled to the data line Dm, and a second electrode thereof is coupled to a first node N1. In addition, a gate electrode of the fourth transistor M4 is coupled to the n-th scan line Sn. The fourth transistor M4 is turned on when the scan signal is supplied to the n-th scan line Sn in order to supply the data signal supplied to the data line Dm to the first node N1.

A first electrode of the first transistor M1 is coupled to the first node N1, and a second electrode thereof is coupled to a first electrode of the sixth transistor M6. In addition, a gate electrode of the first transistor M1 is coupled to a second node N2. The first transistor M1 described above supplies current corresponding to the voltage charged in the storage capacitor Cst to the OLED.

A first electrode of the second transistor M2 is coupled to the second electrode of the first transistor M1, and a second electrode thereof is coupled to a first electrode of the third transistor M3. In addition, a gate electrode of the second transistor M2 is coupled to the second node N2. The second transistor M2 described above controls connection between the second electrode of the first transistor M1 and the first electrode of the third transistor M3 corresponding to a voltage applied to the second node N2.

The first electrode of the third transistor M3 is coupled to the second electrode of the second transistor M2, and a second electrode thereof is coupled to the second node N2. In addition, a gate electrode of the third transistor M3 is coupled to the n-th scan line Sn. The third transistor M3 described above is turned on when the scan signal is supplied to the n-th scan line Sn in order to control connection between the second electrode of the second transistor M2 and the second node N2.

Here, when the third transistor M3 is turned on, the second transistor M2 is connected in a diode form (e.g., diode-connected). In addition, when the second transistor M2 and the third transistor M3 are turned on, the first transistor M1 is connected in a diode form. In relation to this embodiment, detailed description will be described below.

The seventh transistor M7 is coupled between the second node N2 and an initialization power supply Vint. In addition, a gate electrode of the seventh transistor M7 is coupled to the (n−1)-th scan line Sn−1. The seventh transistor M7 described above is turned on when the scan signal is supplied to the (n−1)-th scan lines Sn−1 in order to supply a voltage of the initialization power supply Vint to the second node N2. Here, the initialization power supply Vint is set to have a voltage lower than that of the data signal.

A first electrode of the fifth transistor M5 is coupled to the first power supply ELVDD, and a second electrode thereof is coupled to the first node N1. In addition, a gate electrode of the fifth transistor M5 is coupled to the light emitting control line En. The fifth transistor M5 described above is turned on when the light emitting control signal (e.g., a high level signal) is not supplied from the light emitting line En in order to electrically connect the first power supply ELVDD and the first node N1.

The first electrode of the sixth transistor M6 is coupled to the second electrode of the first transistor M1, and a second electrode thereof is coupled to an anode electrode of the OLED. In addition, a gate electrode of the sixth transistor M6 is coupled to the light emitting control line En. The sixth transistor M6 described above is turned on when the light emitting control signal is not supplied to supply the current supplied from the first transistor M1 to the OLED.

Figure 3:
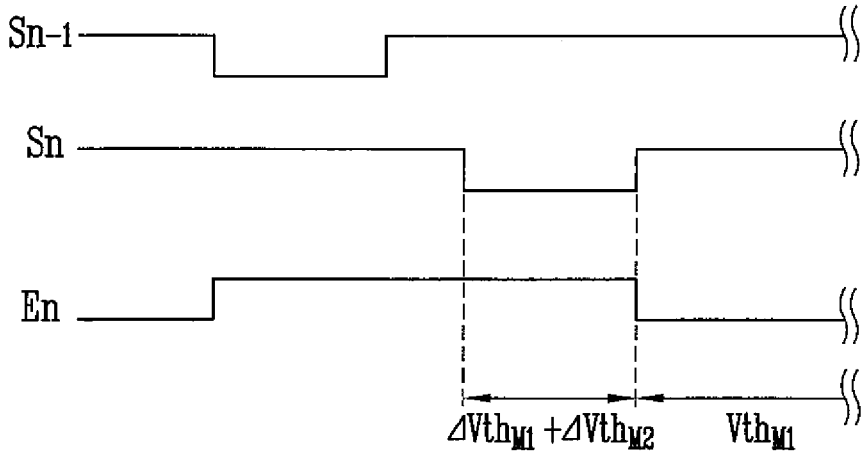
FIG. 3 is a waveform diagram showing a driving waveform supplied to the pixel shown in FIG. 2.

FIG. 3 is a waveform diagram showing a driving waveform supplied to the pixel shown in FIG. 2.

Referring to FIG. 3, first, the scan signal is supplied to the (n−1)-th scan line Sn−1 to turn on the seventh transistor M7. When the seventh transistor M7 is turned on, the voltage of the initiating power supply Vint is supplied to the second node N2.

Thereafter, the scan signal is supplied to the n-th scan line Sn. When the scan signal is supplied to the n-th scan line Sn, the third and fourth transistors M3 and M4 are turned on. When the fourth transistor M4 is turned on, the data signal supplied to the data line Dm is supplied to the first node N1. Here, since the second node N2 has been initialized to the voltage of the initialization power supply Vint, the first and second transistors M1 and M2 are turned on. In this case, the data signal supplied to the first node N1 is supplied to the second node N2 through the first, second, and third transistors M1, M2, and M3.

In this case, the data signal is supplied to the second node N2 through the first and second transistors M1 and M2 each connected as a diode. That is, a voltage obtained by subtracting the threshold voltages of the first and second transistors M1 and M2 from the data signal, is supplied to the second node N2, thereby making it possible to stably compensate for the threshold voltage of the first transistor M1 during a short period of time.

Figure 4A:
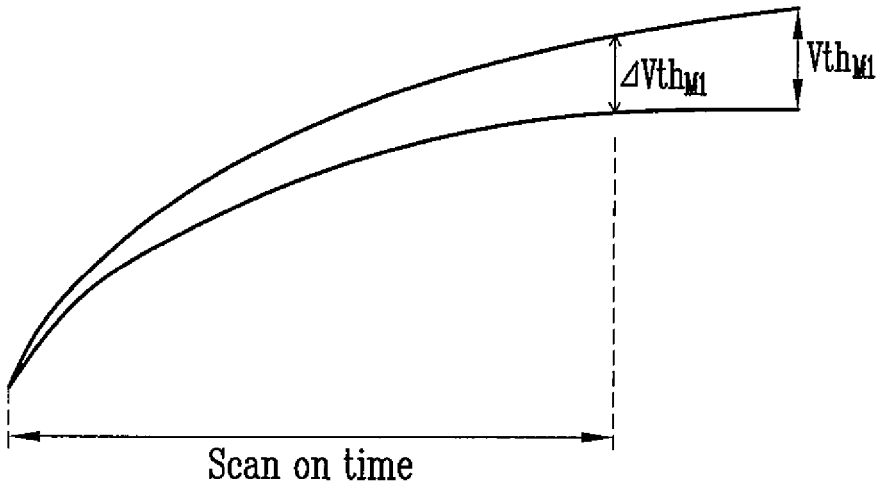
FIGS. 4A and 4B are drawings showing a principle of compensation of the threshold voltage of the driving transistor.

More specifically, the threshold voltage VthM1 of the first transistor M1 is compensated for during a scan-on time as shown FIG. 4A. Here, when the scan-on time is provided for a sufficient period of time, the threshold voltage VthM1 of the transistor M1 may be stably compensated for. However, the scan-on time is determined as a set or predetermined time corresponding to a panel. Therefore, a voltage ΔVthM1 lower than a desired target threshold voltage VthM1 may be compensated for.

Figure 4B:
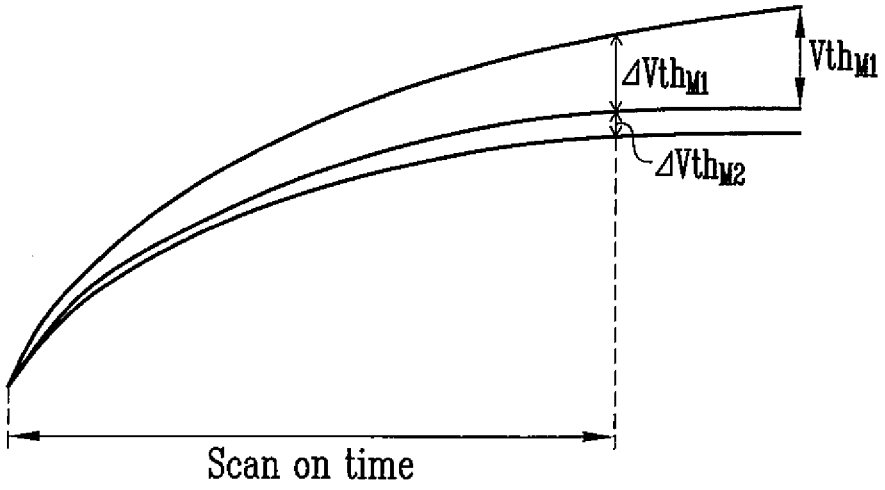

In order to solve the problem described above, in according to the exemplary embodiment of the present invention, a voltage ΔVthM1+ΔVthM2 of the first and second transistors M1 and M2 connected in diode from during the scan-on time, is used to compensate for the threshold voltage VthM1 of the first transistor M1 as shown in FIG. 4B. In other words, a voltage of the data signal is further reduced by the second transistor M2 connected to in diode form, thereby making it possible to stably compensate for the threshold voltage VthM1 of the first transistor M1 during the scan on time.

Particularly, since the second transistor M2 does not supply current to the OLED, channel width and length of the transistor M2 may be variously adjusted with a designer's intentions. Therefore, the designer may consider various variables (for example, the scan-on time, the threshold voltage of the first transistor M1, or the like) to set the threshold voltage of the second transistor M2 to a desired voltage.

After a set or predetermined voltage is charged in the storage capacitor Cst, the supply of the light emitting control signal to the light emitting control line En is interrupted, such that the fifth and sixth transistors M5 and M6 are turned on. When the fifth and sixth transistors M5 and M6 are turned on, a current path from the first power supply ELVDD to the OLED is formed. In this case, the first transistor M1 controls the amount of current flowing from the first power supply ELVDD to the OLED corresponding to the voltage charged in the storage capacitor Cst.

Here, the current flowing from the first transistor M1 to the OLED is determined by the threshold voltage VthM1 of the first transistor M1, regardless of the threshold voltage of the second transistor M2. Here, since the voltage charged in the storage capacitor Cst is set in consideration of the threshold voltage VthM1 of the first transistor M1, an actual current flowing to the OLED may be determined by the data signal regardless of the threshold voltage of the first transistor M1.

Although in FIG. 2 as described above, the pixel 140 includes seven transistors and a single capacitor, the present invention is not limited thereto. In practice, according to the present invention, the data signal is supplied to the storage capacitor through the first threshold voltage corresponding to two transistors diode-coupled to each other during a data writing period, which may be applied to various currently known circuits. Here, during the light emitting period, the pixel circuit 142 supplies current to the OLED corresponding to the second threshold voltage (i.e., the threshold voltage of the driving transistor) whose absolute value is lower than that of the first threshold voltage.

As set forth above, according to the exemplary embodiment of the present device, an organic light emitting display device stores a voltage of the data signal in the storage capacitor through a first threshold voltage having the absolute value higher than that of a second threshold voltage of the driving transistor. In this case, the threshold voltage of the driving transistor may be stably compensated for during the scan-on time.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

pixels, each of the pixels being configured to store a voltage of a data signal in a storage capacitor through a first threshold voltage different from a second threshold voltage of a driving transistor for driving the pixel;

scan lines and light emitting control lines respectively coupled to the pixels; and data lines for supplying the data signal to the pixels, wherein each of the pixels comprises:

a second transistor having a first electrode directly coupled to a second electrode of the driving transistor and directly coupled to a first electrode of an emission control transistor, and a gate electrode directly coupled to a gate electrode of the driving transistor;

an organic light emitting diode;

the driving transistor for controlling an amount of current supplied from a first power supply coupled to a first electrode thereof, to the organic light emitting diode corresponding to a voltage charged in the storage capacitor;

the second transistor coupled between the second electrode and the gate electrode of the driving transistor, and having a gate electrode coupled to the gate electrode of the driving transistor;

a third transistor coupled between the second transistor and the gate electrode of the driving transistor, and configured to be turned on when a scan signal is supplied to a current scan line;

a fourth transistor coupled between the data line and the first electrode of the driving transistor, and configured to be turned on when the scan signal is supplied to a current scan line;

a fifth transistor coupled between the first power supply and the first electrode of the driving transistor, and configured to be turned on when the light emitting control signal is not supplied to a corresponding one of the light emitting control lines; and a seventh transistor coupled between the gate electrode of the driving transistor and an initialization power supply, and configured to be turned on when the scan signal is supplied to a previous scan line, wherein the emission control transistor is a sixth transistor coupled between the second electrode of the driving transistor and the organic light emitting diode, and configured to be turned on when the light emitting control signal is not supplied.

2. The organic light emitting display device according to claim 1, wherein an absolute value of the first threshold voltage is set to be higher than that of the second threshold voltage.

3. The organic light emitting display device according to claim 1, wherein the first threshold voltage is obtained by adding a threshold voltage of a separate transistor connected in a diode form to the second threshold voltage.

4. The organic light emitting display device according to claim 1, wherein the first threshold voltage is an absolute voltage obtained by adding the threshold voltage of the second transistor to the threshold voltage of the driving transistor.

5. The organic light emitting display device according to claim 1, wherein the initialization power supply is set to have a voltage lower than that of the data signal.

6. A pixel comprising:

an organic light emitting diode;

a storage capacitor coupled between a node and a first power supply;

a first transistor having a first electrode coupled to the first power supply, a second electrode coupled to the organic light emitting diode, and a gate electrode coupled to the node;

a second transistor coupled between the second electrode of the first transistor and the node, and a gate electrode of the second transistor being directly coupled to the node, wherein a first electrode of the second transistor is directly coupled to the second electrode of the first transistor and directly coupled to a first electrode of an emission control transistor;

a third transistor coupled between the second transistor and the node, and a gate electrode of the third transistor being coupled to a current scan line;

a fourth transistor coupled between a data line and the first electrode of the first transistor, and a gate electrode of the fourth transistor being coupled to the current scan line;

a fifth transistor coupled between the first electrode of the first transistor and the first power supply, and a gate electrode of the fifth transistor being coupled to a light emitting control line; and a seventh transistor coupled between the node and an initializing power supply, and a gate electrode of the seventh transistor being coupled to a previous scan line, wherein the emission control transistor is a sixth transistor coupled between the second electrode of the first transistor and the organic light emitting diode, and a gate electrode of the sixth transistor is coupled to the light emitting control line.

7. The pixel according to claim 6, wherein a light emitting control signal supplied to the light emitting control line is overlapped with scan signals supplied to the previous scan line and the current scan line.

8. The pixel according to claim 7, the fifth and sixth transistors are configured to be turned off when the light emitting control signal is supplied, and turned on in other cases.

* * * * *